US007052080B2

(12) United States Patent
Knight et al.

(10) Patent No.: US 7,052,080 B2
(45) Date of Patent: May 30, 2006

(54) FRAME FOR SUPPORTING A BACK PACK AND PROVIDING A SEAT STRUCTURE

(76) Inventors: David Perry Knight, Rt. 3 Box 3486-8, Cassville, MO (US) 65625; Kathy Frances Knight, RT. 3 Box 3486-8, Cassville, MO (US) 65625

( * ) Notice: Subject to any disclaimer, the term of this patent is extended or adjusted under 35 U.S.C. 154(b) by 0 days.

(21) Appl. No.: 10/402,263

(22) Filed: Mar. 28, 2003

(65) Prior Publication Data

US 2004/0189062 A1 Sep. 30, 2004

(51) Int. Cl.
*A47C 1/00* (2006.01)

(52) U.S. Cl. ..... 297/4; 297/452.64; 297/188.12; 224/155

(58) Field of Classification Search ..... 297/188.12, 297/188.09, 188.08, 188.2, 4, 129, 338, 452.64, 297/452.2, 440.24, 217.1, 344.18; 224/275, 224/155; 248/650, 649, 346.05
See application file for complete search history.

(56) References Cited

U.S. PATENT DOCUMENTS 2,076,510 A * 4/1937 Ficks ..... 297/452.64
3,266,686 A * 8/1966 Griffith ..... 224/155
5,409,291 A * 4/1995 Lamb et al. ..... 297/129
5,573,155 A * 11/1996 Sadler ..... 224/155
5,845,962 A * 12/1998 Lin ..... 297/54
5,957,349 A * 9/1999 Krulik ..... 224/155
6,000,752 A * 12/1999 Shyr ..... 297/188.08
6,079,599 A * 6/2000 Nordstrom et al. ..... 224/153
6,547,324 B1 * 4/2003 Ammann, Jr. ..... 297/129
6,651,853 B1 * 11/2003 Higgins et al. ..... 224/155
6,702,384 B1 * 3/2004 Brown ..... 297/344.18
6,923,419 B1 * 8/2005 George et al. ..... 248/676

* cited by examiner

*Primary Examiner*—Milton Nelson, Jr.
(74) *Attorney, Agent, or Firm*—Gable and Gotwals

(57) ABSTRACT

A frame for supporting a back pack and providing a seat structure is formed of a rigid assembly having side portions with four downwardly extending tubular leg members and includes spaced apart, paralleled, lateral members extending between the side portions. A leg extender is telescopically received in each of the four tubular leg members. A pad member having a lower horizontal surface is affixed to a lower end of each of the leg extenders. A locking member at the lower end of each of the tubular leg members provides adjustable spacing of the leg extenders. The frame is configured to receive a flexible back pack between the legs thereof and is adaptable to support a horizontal seat surface when the pad members are resting on the earth's surface.

3 Claims, 3 Drawing Sheets

FRAME FOR SUPPORTING A BACK PACK AND PROVIDING A SEAT STRUCTURE

CROSS-REFERENCE TO RELATED APPLICATIONS

This application is not related to any pending United States or foreign application nor has it been derived with regard to any federally sponsored research or development.

BACKGROUND OF THE INVENTION

Field of the Invention

The invention relates to a frame for supporting a back pack and to a frame convertible into a portable seat.

Others have provided back packs and portable seats. A difference, however, in that the present disclosure provides a tubular frame that functions as a skeletal external framework for containing and supporting a back pack and wherein the framework also functions as a seat.

BRIEF SUMMARY OF THE INVENTION

The invention herein provides a unique frame for supporting a back pack and for forming a seat structure for use by a backpacker. Backpacking is a very popular activity throughout the world in that it is a part of human nature to desire to occasionally escape from the close human contact of our modern society and to enjoy the beauties of nature. A very successful way in accomplishing this is for a person to equip himself or herself to go into uninhabited areas and carry along supplies, equipment, food and so forth that will permit staying in a remote location for a single day and night, up to an extended length of time. For this reason, backpackers have become very proficient in arranging their equipment and supplies so they can be self-sustaining. At the same time, it is important that the equipment employed by a backpacker be light and portable.

A typical back pack is in the form of a flexible pouch that can be readily opened and closed and when closed, is substantially waterproof and that can be used to receive clothing, cooking utensils, bedding, food, toiletries and so forth. The problem with a completely flexible back pack is that it is awkward to carry. For this reason, back packs have evolved that have a degree of rigidity. Some back packs have internal reinforcing to provide rigidity. However, such reinforcing typically is not rigid enough to form a true structural frame for a back pack. In addition, a backpacker frequently needs a convenient and comfortable place to sit. This is so during long walking excursions as well as at camp sites. While a backpacker can, of course, always sit or recline on the earth, nevertheless it is desirable to have a seating surface spaced above the earth.

The invention herein is exemplified by a frame for supporting a back pack and providing a seat structure. The frame is formed of a rigid assembly having side portions with four downwardly extending tubular leg members and includes spaced apart, paralleled, lateral members extending between the side portions and including a third lateral member extending between the horizontal members and spaced from and parallel to the first lateral member, the third lateral member serving as a handle member.

A leg extender is telescopically received in each of the four tubular leg members. A pad member having a lower horizontal surface is affixed to a lower end of each of the leg extenders. A locking member at the lower end of each of the tubular leg members provides adjustable spacing of the leg extenders. The frame is configured to support a back pack between the legs and is adaptable to support a horizontal seat surface when the pad members are resting on the earth's surface.

Adjustable length flexible straps can be affixed to the frame to extend over the shoulders of a user in the manner that straps are customarily employed for carrying a back pack.

DETAILED DESCRIPTION OF THE INVENTION

Figure 1:
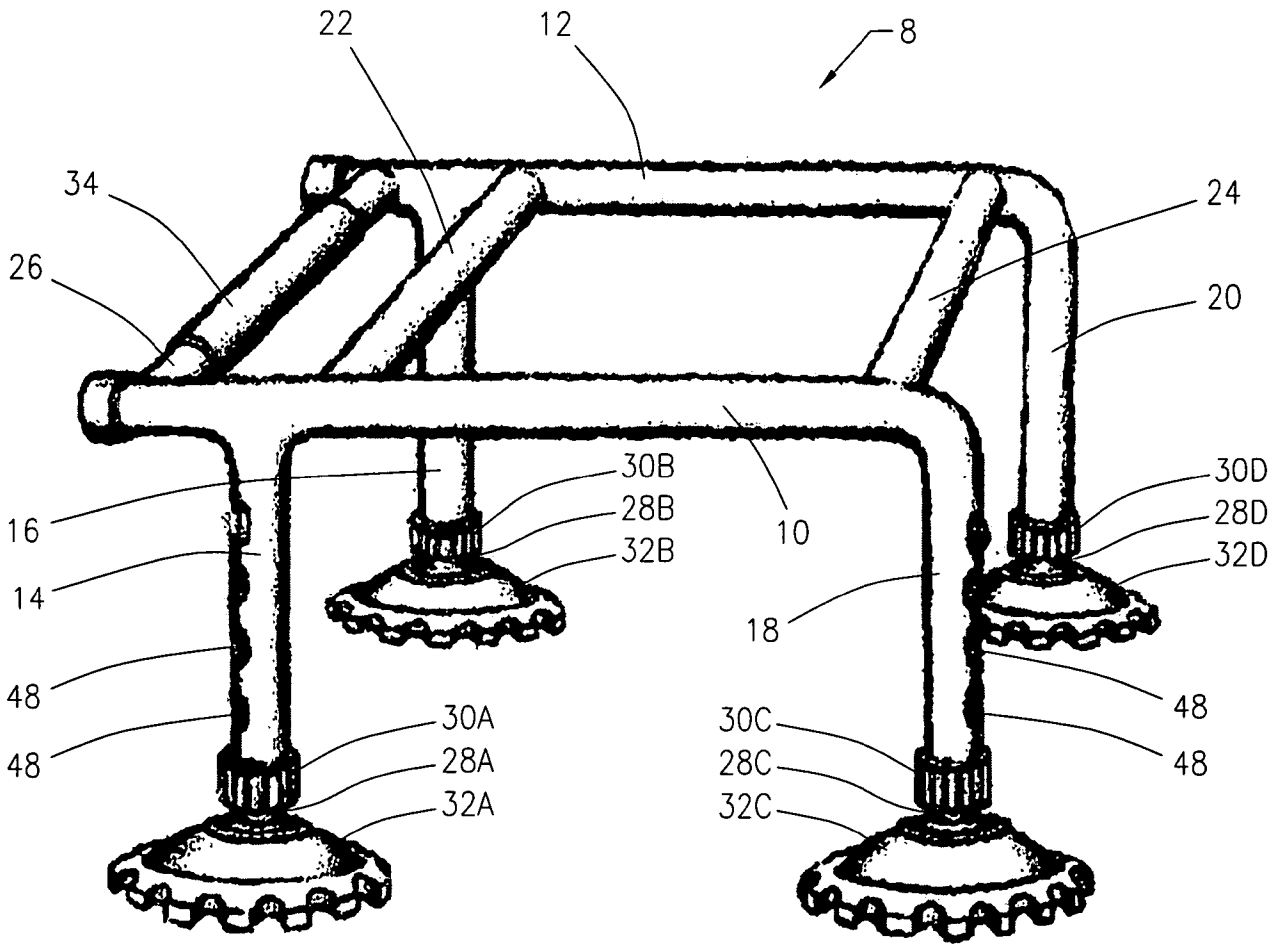
FIG. 1 is an isometric view of the frame that is the essence of the invention. The frame provides support and protection for a flexible back pack and a structure for forming a seat that is specifically adaptable for use on soft, uneven and sloping surfaces.

It is to be understood that the invention that is now to be described is not limited in its application to the details of the construction and arrangement of the parts illustrated in the accompanying drawings. The invention is capable of other embodiments and of being practiced or carried out in a variety of ways. The phraseology and terminology employed herein are for purposes of description and not limitation.

| Elements illustrated in the drawings are identified by the following numbers: | |
|---|---|
| 8 | Frame |
| 10 | First side portion |
| 12 | Second side portion |
| 14 | Forward leg member |
| 16 | Forward leg member |
| 18 | Leg member |
| 20 | Leg member |
| 22 | First lateral member |
| 24 | Second lateral member |
| 26 | Third lateral member |
| 28 A–D | Telescopic leg member |
| 30 A–D | Locking members |
| 32 A–D | Pad members |
| 34 | Wrapping |
| 36 | Back pack |
| 38 | Straps and buckles |
| 40 A–B | Back straps |
| 42 | Webbing |
| 44 | Seat member |
| 46 | Clips |
| 48 | Holes |

As seen in FIG. 1, a rigid frame is generally indicated by the numeral 8. Frame 8 can be used for supporting a back pack and/or providing a seat structure as will be described. The frame assembly is formed of tubular material that is bent as required or affixed together, such as by welding. The frame has a first side portion 10 and an opposed, parallel substantially identical second side portion 12. Each of the side portions 10 and 12 is formed of rigid tubular material, such as aluminum or plastic. The opposed ends of each of the side portions have leg members. Specifically, first side portion 10 has a downwardly extending forward leg member 14 while the second side portion 12 has a downwardly extending forward leg member 16. First side portion 10 has a downwardly extending rearward leg member 18 while second side portion 12 has a similar downwardly extending rearward leg member 20. Thus, there are four paralleled, spaced apart downwardly extending leg members 14, 16, 18 and 20.

A first lateral member 22 extends between side portions 10 and 12. The first lateral member 22 is adjacent forward leg members 14 and 16. Spaced from and paralleled first lateral member 22 is a second lateral member 24 that is adjacent rearward legs 18 and 20.

Extending between first and second side portions 10 and 12 is a third lateral member 26 that is forwardly of forward leg members 14 and 16. The third lateral member 26 is parallel to and spaced near first lateral member 22 and functions in the manner of a handle for conveniently moving or positioning the frame.

Telescopically received within each of leg members 14, 16, 18 and 20 is a telescopic member, indicated by element numbers 28A through 28D. Telescopic leg members 28A–D are each axially slidable within a leg member. Each of the telescopic leg members 28A–D is capable of being selectably extendable from within an associated leg member and is lockable in a selectable position such as by locking members 30A–30D.

Affixed to the lower end of each of the telescopic leg members 28A–D is a pad member, the pad members being indicated by 32A–32D. Each of the pad members has a lower horizontal surface that is not seen in the drawings. The pad members are dimensioned so as to provide level surfaces for supporting the legs members of the frame and are of large enough area that the legs members will not sink into the earth, even relatively soft earth, on which the frame may be positioned when it is used as a seat.

The third lateral member 26 is shown with a wrapping 34 of non-metallic material to facilitate grasping of the frame when it is being moved about.

Figure 3:
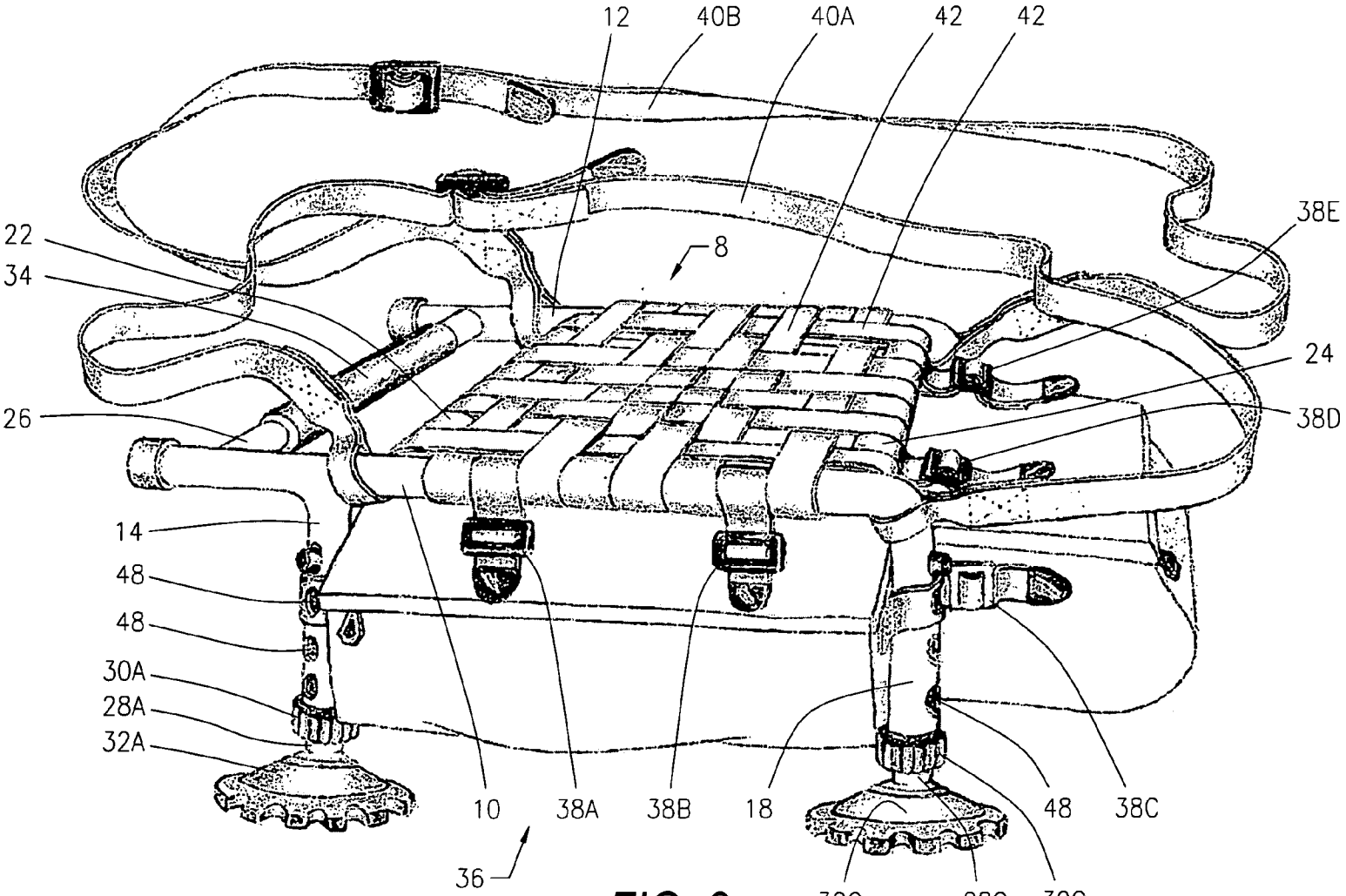
FIG. 3 illustrates the structural framework for a back pack having a back pack mounted within it and shows straps which can be extended over the shoulder of a user. The structural frame is provided with telescopically extendable legs having large area pads permitting the frame to be used to form a seat that is particularly suited for use on soft, uneven and slopping sloping surfaces.

The frame of FIG. 1 has substantial utility as forming the basis of an assembly for back packing and camping. The frame is configured and dimensioned such that a back pack generally indicated by the numeral 36 in FIG. 3 can be supported in engagement with the frame side portions 10 and 12 and lateral members 22 and 24 and with frame legs 14, 16, 18 and 20 providing structural support and protection. The back pack 36 may be secured to frame 8 such as by means of belting as shown in FIG. 3 or if it is desired that the back pack 36 be more permanently secured to frame 8, the back pack can be secured by straps or loops held by rivets or permanent sewing. In the arrangement of FIG. 3, back pack 36 is shown as being supported to frame 8 by straps and buckles as indicated by numerals 38A–38E.

The combination of the frame 8 and back pack 36 of FIG. 3 provides an assembly useable for carrying on the back of a user. For this purpose, back straps 40A and 40B are employed. The back straps include buckles in the usual manner to permit adjusting the length to fit the size of the individual user.

Further, in order to improve the comfort of carrying frame 8 that supports a back pack 36, the frame preferably includes webbing 42 extending between frame side portions 10 and 12 and first and second lateral members 22 and 24. The webbing 42 may be made of canvas or plastic webbing material as is commonly used such as in providing webbed seating for lawn chairs or the like.

Figure 2:
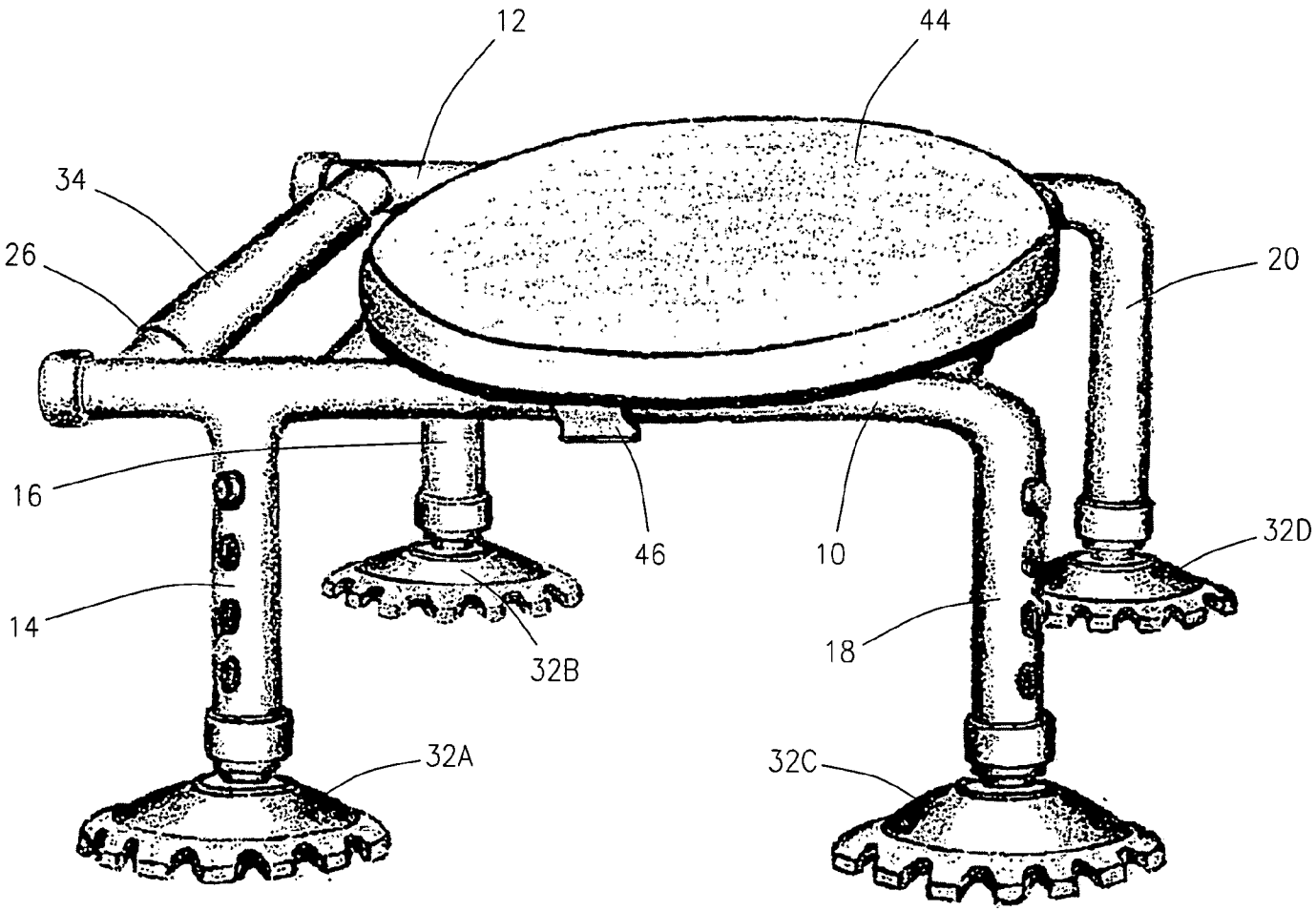
FIG. 2 is an isometric view of the back pack frame of this invention showing an alternate seat formed of a rigid structure.

The frame 8 with the webbing 42 applied as in FIG. 3 provides a comfortable seat when the user positions the frame on the ground with the lower surfaces of pad members 32A–32D in contact with the earth's surface. The frame and webbing combination can be used as a seat while the back pack 36 is in place or the back pack can be removed since it is not required for seating purposes. A substantially rigid seat surface formed of wood or plastic can be provided as shown in FIG. 2. In this figure, the seat is in the form of a circular seat member 44 that can be removably secured to the frame such as by clips 46 that removably attach to the frame side portions 10 and 12 and lateral members 22 and 24.

As previously stated, the telescopic leg members 28A–28D can be selectably held in extended positions by means of locking members 30A–30D as seen in FIG. 3. Another way of holding the telescopic leg members in selectable extended positions is by the provisions of a plurality of spaced apart holes 48 that are provided in each of the leg members as seen in FIG. 1. Pins (not shown) can be selectably positioned in holes 48 according to the elevation required of the seat.

The back pack frame and seat structure described herein is useful for back packers, campers, bank fishing, hunters, outdoor and photographers. It works great on soft earth as well as on rocky and uneven terrains.

The invention claimed is:

1. A frame for supporting a back pack and for providing a seat structure when the frame is positioned on the earth's surface, comprising:

a rigid assembly having a first side portion and an opposed, paralleled substantially identical second side portion, each side portion being formed of a tubular horizontal member with opposed ends and including forward and rearward downwardly extending tubular leg members affixed to each of said side portions thereby providing four spaced apart, paralleled leg members and including first and second spaced apart, paralleled, horizontal lateral members extending between said side portions, and including a third lateral member extending between said horizontal members and spaced from and parallel to said first lateral member, said third lateral member serving as a handle member;

a leg extender telescopically received in each of said four downwardly extending tubular leg members;

a pad member having a relatively large lower horizontal surface dimensioned to resist penetration of the earth's surface and affixed to a lower end of each said leg extender;

a locking member for each of said tubular leg members for selectably adjusting the spacing of each of said pad member lower horizontal surface with respect to a horizontal plane of the frame, said frame being adaptable to support a back pack between said downwardly extending leg members and said assembly being adaptable to support a horizontal seat forming member when said horizontal surfaces of said pads are resting on the earth's surface; and a semi-permanently attached seat forming member configured to fit comfortably against a user's back when transporting the assembly.

2. A frame according to claim 1 wherein said seat forming member is formed by flexible web straps, part of which extend between said tubular horizontal members and part of which extend between said spaced apart lateral members.

3. A frame according to claim 1 including at least two adjustable length flexible straps each having opposite ends affixed to said assembly, and being extendable over a user's shoulders whereby the frame can be removably secured to a user's back.

* * * * *